US005103145A

United States Patent [19]

Doran

[11] Patent Number: 5,103,145

[45] Date of Patent: Apr. 7, 1992

[54] LUMINANCE CONTROL FOR CATHODE-RAY TUBE HAVING FIELD EMISSION CATHODE

[75] Inventor: Robert W. Doran, Acton, Mass.

[73] Assignee: Raytheon Company, Lexington, Mass.

[21] Appl. No.: 578,717

[22] Filed: Sep. 5, 1990

[51] Int. Cl.[5] ..... H01J 29/52

[52] U.S. Cl. ..... 315/381; 315/366; 313/309; 313/336

[58] Field of Search ..... 315/366, 381, 169.3; 313/336, 309, 351

[56] References Cited

U.S. PATENT DOCUMENTS

| | | | |
|---|---|---|---|
| 3,755,704 | 8/1973 | Spindt et al. | 313/309 |
| 4,575,765 | 3/1986 | Hirt | 313/309 |
| 4,818,914 | 4/1989 | Brodie | 315/169.3 |
| 4,940,916 | 7/1990 | Borel et al. | 313/336 |
| 4,987,377 | 1/1991 | Gray et al. | 313/309 |

*Primary Examiner*—Theodore M. Blum
*Attorney, Agent, or Firm*—Christopher L. Maginniss; Richard M. Sharkansky

[57] ABSTRACT

A field emission cathode for use in a cathode-ray tube (CRT) includes groups of electron emission cells that produce different degrees of luminance on the phosphor-coated CRT screen. The cells replace the conventional CRT cathode and are fabricated on a planar surface. Each cell comprises a fixed number of discrete electron emitters, and the groups comprise different numbers of cells, typically in binary relation to one another. The cell groups of are interconnected via separate drive lines; each group is activated by applying voltage to its line. Different combinations of groups may be activated to achieve different brightness intensities on the CRT screen. A cathode having fifteen cells arranged in four groups (1, 2, 4 and 8 cells) is capable of producing sixteen shades of gray.

21 Claims, 5 Drawing Sheets

LUMINANCE CONTROL FOR CATHODE-RAY TUBE HAVING FIELD EMISSION CATHODE

BACKGROUND OF THE INVENTION

The present invention relates generally to cathode-ray tube (CRT) displays and, more particularly, to a circuit for driving a selected number of elements of field emission arrays on the cathode of a CRT to thereby provide a linear range of brightnesses to the individual pixels of the display.

A cathode-ray tube (CRT) is a particular configuration of vacuum tube useful in a wide variety of electronic applications, most commonly as a display device in television receivers, oscilloscopes and computer monitors. The primary function of a CRT is to convert the information contained in an electrical input signal to electron beam energy, and to convert that energy into light energy so as to provide a visual display of the input signal information.

In a basic cathode-ray tube, electrons are emitted from a thermionic cathode and controlled by control grids. The beam of free electrons is accelerated through an anode section by magnetic or electrostatic attraction forces, and is deflected, typically on horizontal and vertical axes, by a magnetic deflection coil or by electrostatic deflection plates. The electrons of the beam strike a light-emitting phosphor-coated surface, emitting visible light for a short interval of time.

The input signal containing the information to be displayed is applied between the control grids and the cathode. However, the relationship between the beam current and the control voltage (commonly referred to as the gamma characteristic) is a very nonlinear function, and relatively complex compensation circuits are required to be coupled between the input signal and the control grids in order to provide a linear range of display intensities.

In recent years, the widespread activity in the area of flat panel displays has spawned the development of non-thermionic cathodes, illustratively, field emission arrays which may be of the type developed at SRI International, Menlo Park, Calif., which are commonly referred to as Spindt cathodes, after Charles A. Spindt.

The use of an array of field emission cathodes in a cathode-ray tube, in place of the conventional thermionic cathode, would appear to provide certain advantages. In particular, the use of field emission cathodes allows much higher current densities. Additionally, elimination of a heater element may be expected to extend the life of the tube.

On the other hand, however, a field emission cathode is even more non-linear with respect to the emission of electrons in response to the driving signal than its thermionic counterpart, and an even more complex compensating circuit is required to provide a linear range of CRT luminances over the range of input signal voltages. It is clear that there exists the need for a simpler method of providing linear brightness control of a CRT having a field emission array cathode.

SUMMARY OF THE INVENTION

It is therefore an object of the present invention to provide an improved cathode-ray tube.

It is an additional object of the present invention to provide a cathode-ray tube having an improved field emission cathode.

It is a still further object of the present invention to provide a field emission cathode for use in a cathode-ray tube wherein the cathode is configured to be controlled so as to provide a linear range of brightnesses.

In accordance with the principles of the present invention, there is disclosed an electron emission apparatus which comprises a multiplicity of field emission electron emitters, each of the emitters comprising a cathode electrode and a gate electrode and responsive to a predetermined potential therebetween for emitting electrons from the cathode. All of the cathode electrodes are electrically interconnected. The gate electrodes are interconnected to form a first plurality of cells, each of the cells comprising an equal number of electron emitters. The cells are interconnected to form a second plurality of groups, the groups comprising different numbers of cells. The apparatus further comprises means for selectively applying the predetermined potential between the cathodes and the interconnected gate electrodes of the interconnected cells of the groups.

In a particular application of the present invention, there is disclosed a cathode-ray tube (CRT) comprising a sealed envelope having a surface therein responsive to electron beam current for providing light energy. The CRT further comprises electron emission means within the envelope responsive to an input signal for providing an electron beam current including: a multiplicity of field emission electron emitters, each of the emitters comprising a cathode electrode and a gate electrode and responsive to a predetermined potential therebetween for emitting electrons from the cathode. All of the cathode electrodes are electrically interconnected. The gate electrodes are interconnected to form a first plurality of cells, each of the cells comprising an equal number of electron emitters. The cells are interconnected to form a second plurality of groups, the groups comprising different numbers of cells. The electron emission means is responsive to the input signal for selectively applying the predetermined potential between the cathodes and the interconnected gate electrodes of the interconnected cells of the groups, wherein the emission of electrons from the cathodes is related to the amplitude of the input signal. The CRT additionally comprises means within the envelope for accelerating the electron beam current from the electron emission means onto the surface, and means for selectively deflecting the electron beam current to positions on the surface.

With this arrangement there is provided a cathode-ray tube which generates a field emission electron beam, wherein the electron emitters may be controlled so as to display a linear range of luminances.

BRIEF DESCRIPTION OF THE DRAWINGS

Other features and advantages of the present invention will be more fully understood from the following detailed description of the preferred embodiment, the appended claims, and the accompanying drawings, in which:

DESCRIPTION OF THE PREFERRED EMBODIMENT

Figure 1:
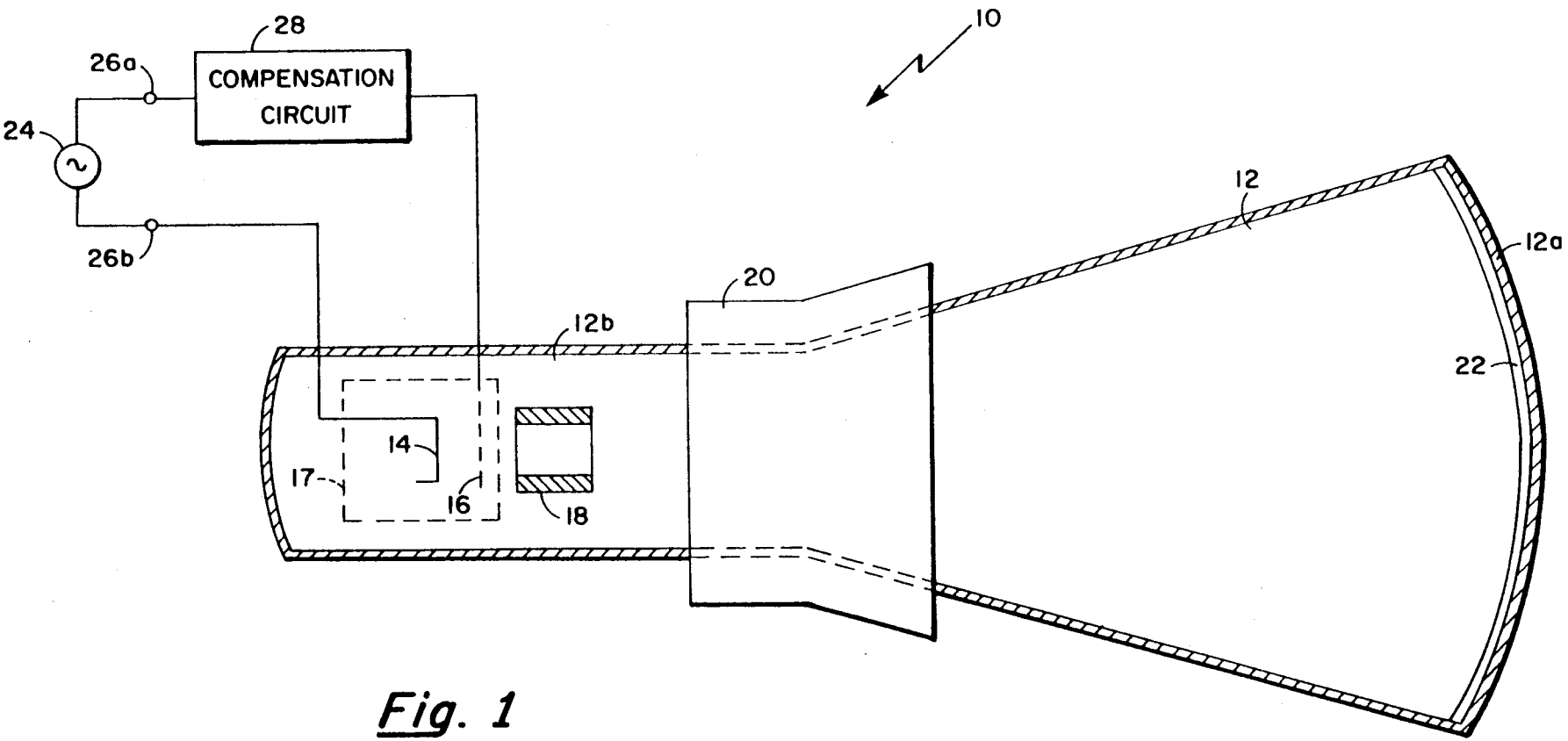
FIG. 1 illustrates in partly schematic form a typical cathode-ray tube (CRT) in which the cathode of the present invention may be included.

Referring to FIG. 1, there is shown a partly-schematic illustration of a cathode-ray tube (CRT) 10 into which the present invention may be incorporated. CRT 10 typically includes a sealed glass tube 12 having an inner surface 12*a* coated with a layer of light-emitting phosphors 22. In a conventional CRT, the electrodes, including cathode 14, control grid 16 and anode 18, are located within the neck 12*b* of tube 12.

Electrons are emitted from cathode 14 and accelerated through anode 18, wherein their flow rate is controlled by control grid 16, also referred to as gate 16. In the case of a conventional thermionic cathode, the emission of the electrons is stimulated by heat applied to the cathode, typically by an adjacent heater, such as a filament (not shown in the CRT of FIG. 1). In the case of a field emission cathode, which is the form of cathode used in the CRT of the present invention, cathode 14 and gate 16 are incorporated into a single structure 17. In this configuration, electron emission from cathode 14 is induced by the presence of an electric field, typically provided by a potential difference between cathode 14 and gate 16.

The beam of electrons, emitted from cathode 14, controlled by gate 16 and accelerated through anode 18, is directed toward various locations on phosphor-coated surface 12*a*. Steering of the electron beam is effected by controlled currents applied through windings (not shown) in magnetic yoke 20, thereby providing the required horizontal and vertical deflection of the beam.

Figure 2:
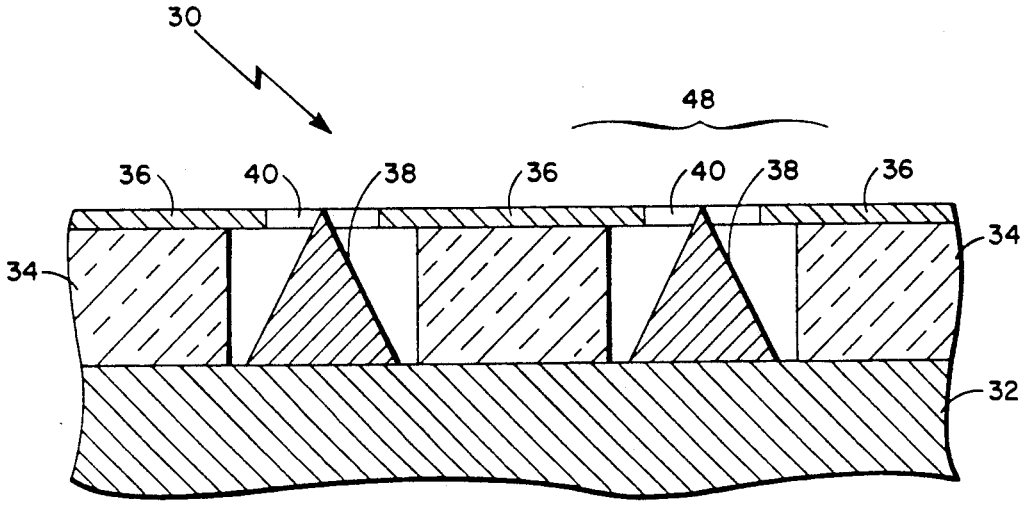
FIG. 2 is a sketch in cross section of an array of thin-film elements comprising an electron emission apparatus which may be of the type used in the CRT of FIG. 1.

Referring to FIG. 2, there is a highly magnified sketch in cross section of a thin-film implementation of cathode and gate electrodes, which may be of the type comprising the electron emission apparatus of the present invention. Electron emission apparatus 30 includes an electrically conductive substrate 32, illustratively a wafer of doped silicon, which serves as a common conductor for all of the cathodes 38. A layer 34 of electrically insulating material is affixed to substrate 32, and a thin conductive layer 36, which forms the gate electrode, overlays layer 34. A plurality of apertures 40 in layer 36 extend through insulating layer 34 down to substrate 32, thereby forming a plurality of "wells" in apparatus 30. Cathodes 38, situated within each of these wells, comprise generally conical structures fabricated of a conductive material, illustratively a metal such as molybdenum, which are all electrically connected via their contact with substrate 32.

It will be easily understood by one with knowledge in the art how to fabricate apparatus 30 as shown in FIG. 2, for example, using well-known photolithographic processes. Briefly, in a preferred process, an oxide film 34, illustratively silicon dioxide ($SiO_2$) about 0.75 micron thick, is vacuum deposited over a doped silicon wafer 32 to serve as a spacer and electrical insulator between the cathodes 38 and gates 36. The gate electrodes 36 comprise a layer of vacuum-deposited molybdenum having a thickness of approximately 0.75 micron.

An array of holes 40, each approximately one micrometer in diameter, is etched through the gate material 36 and the insulating oxide layer 34, extending down to the conductive substrate 32. The reactive ion etching process typically employed to form holes 40 in the oxide layer 34 produces a slight undercutting beneath gate layer 36, leaving the edge of apertures 40 slightly overhanging, as illustrated in FIG. 2.

Cathodes 38 are all formed simultaneously, typically by vacuum evaporation of molybdenum in a direction perpendicular to substrate layer 32. Prior to, and during this evaporation, other, chemically removable, materials are vacuum deposited at near-grazing incidence, gradually closing holes 40 in gate electrodes 36 through which the evaporated molybdenum passes, to form deposits of decreasing diameter, eventually resulting in cone-shaped field-emitters 38 with the cone tips approximately in the plane of the top surface of gate electrodes 36. The cone shape and dimensions are very nearly identical among cathodes 38, with the top radius about 30–40 nanometers.

The individual electron emitters 48, each comprising a cathode 38 and the surrounding gate electrode layer 36, may be grouped in arrays. These arrays, hereinafter referred to as cells, may illustratively comprise nine emitters, grouped in a three-by-three square matrix, or 16 emitters, grouped in a four-by-four square matrix. In this way the failure of one or two emitters within a cell does not have a significant effect in the overall emission performance of the cell.

Figure 3:
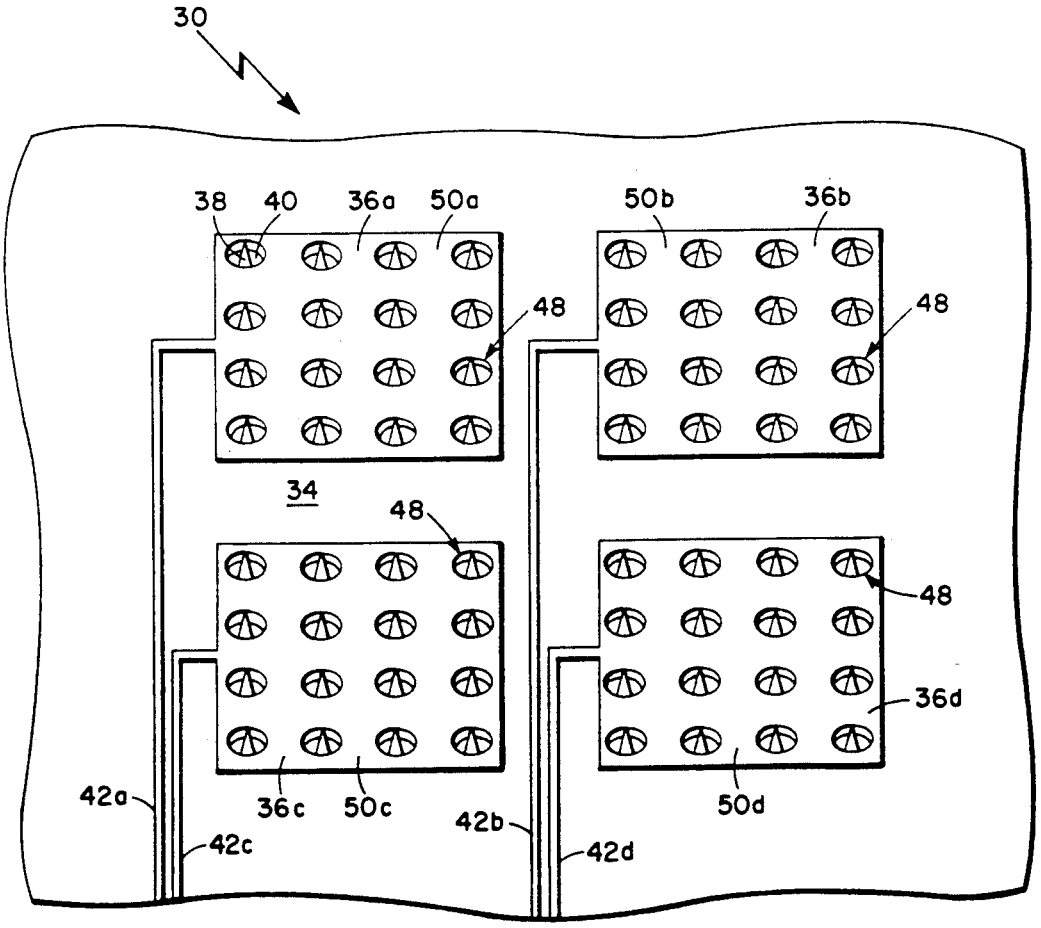
FIG. 3 illustrates aggregations of electron emitters of FIG. 2 into cells.

Referring to FIG. 3, there is shown a portion of an electron emission apparatus 30 in accordance with the teachings of the present invention. FIG. 3 illustrates four cells 50, shown individually as cells 50*a*, 50*b*, 50*c* and 50*d*, each comprising sixteen electron emitters 48 in a four-by-four matrix. As per an earlier discussion, it will be recognized that all cathodes 38 are electrically interconnected via substrate 32 (not shown). However, it will be seen from this view that the gate electrodes 36 of each cell 50 are electrically isolated from one another. The gate electrode 36*a* of cell 50*a* is electrically isolated from gate electrodes 36*b*, 36*c* and 36*d*, which gate electrodes are all isolated one from the other. Thus, the sixteen electron emitters 48 of each cell 50*a*, 50*b*, 50*c* and 50*d*, operate together, but independently of the electron emitters 48 of each other cell.

The photolithographic process for fabricating the arrangement of FIG. 3 will be easily recognized by those knowledgeable in the art. Typically, a masked deposition process allows metallization on insulating layer 34 of the zones comprising gate electrodes 36*a*, 36*b*, 36*c* and 36*d*, and conductive leads 42*a*, 42*b*, 42*c* and 42*d*, while leaving the balance of the surface unmetallized.

In accordance with the principles of the present invention, the cells 50, as shown in FIG. 3, are driven in groups, wherein each group may comprise a different number of cells. In a preferred embodiment, the number of cells per group varies in accordance with a binary progression. Thus, group A may include one cell, group B may include two cells, group C may include four cells, etc. All cathodes in all of the cells in all of the groups are interconnected and brought out as a single lead. All of the gate electrodes in all of the cells in each group are interconnected, and each group has a single lead.

Since the maximum beam current from each group is determined by its number of cells, the total current from a group according to this exemplary embodiment is double that of the preceding group. By selectively enabling various combinations of groups via their signal leads, the total CRT beam current may be controlled in a very linear manner. The CRT cathode essentially becomes a digital-to-analog converter with a resolution determined by the number of bits, or cell groups in this case. In an example where there are four groups, the largest of which has eight cells, the CRT could thus display $2^4=16$ shades of gray, including black (all groups off).

Figure 4A:
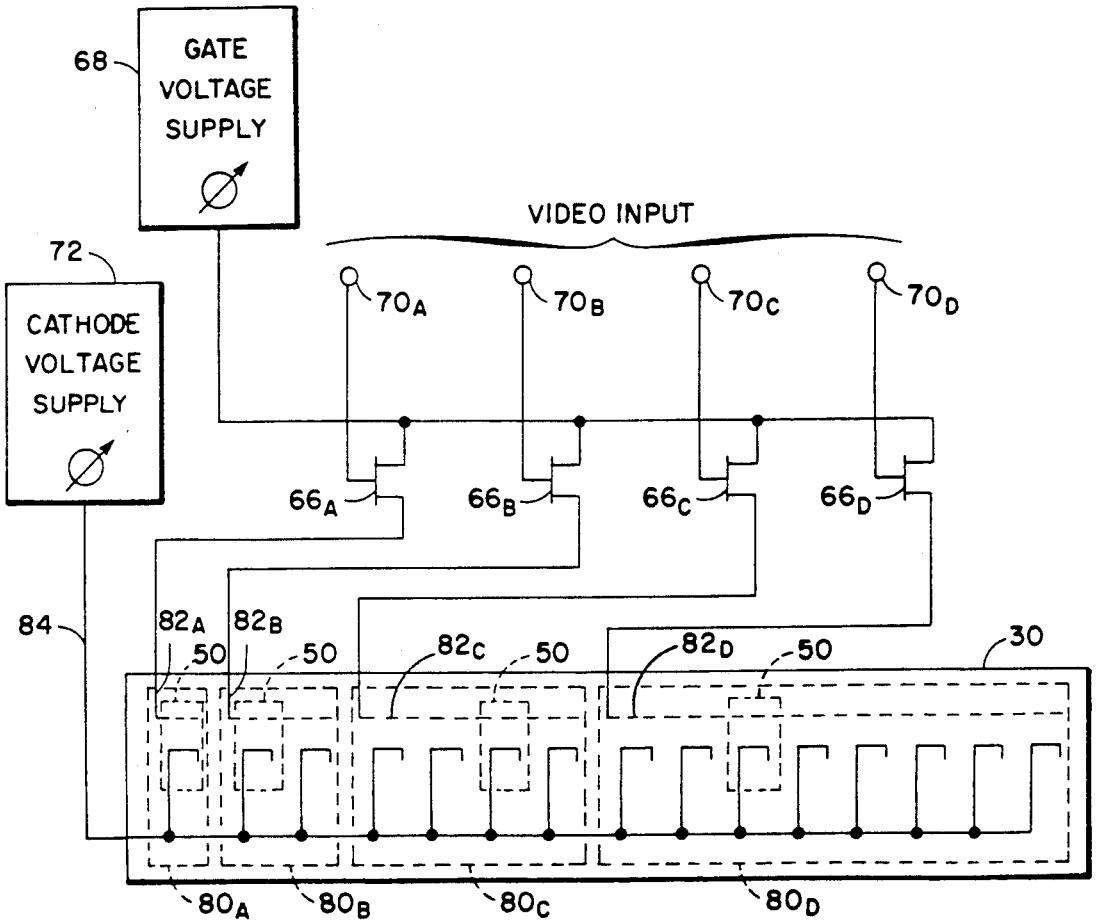
FIG. 4*a* illustrates, in schematic diagram form, a first embodiment of an arrangement for selectively driving groups of electron emitter cells according to the present invention.

Referring to FIG. 4a, there is shown a driver circuit arrangement for groupings of cells of electron emitters according to one embodiment of the present invention. The driver circuit arrangement receives video information at input terminals $70_A$, $70_B$, $70_C$ and $70_D$, referred to collectively as input terminals 70. The video information at input terminals 70, which may be of the type typically used in computer-controlled display systems, is provided in digital form having a binary relationship among the weightings of signal levels at successive terminals 70. The signals at input terminals $70_A$, $70_B$, $70_C$ and $70_D$ are individually coupled to control input terminals of electronic switching devices $66_A$, $66_B$, $66_C$ and $66_D$, which devices are illustratively shown as field-effect transistor (FET) switches. These four switching devices, referred to collectively as switching devices 66, when enabled via an enabling voltage level at their respective control input terminals, switch a voltage potential across corresponding electron emission cells of apparatus 30, wherein the voltage potential is determined by the voltage outputs of gate voltage supply 68 and cathode voltage supply 72, both of which may be adjustable so as to provide a range of output voltages.

In this example, electron emission apparatus 30 comprises fifteen cells 50, arranged into four groups $80_A$, $80_B$, $80_C$ and $80_D$, referred to collectively as groups 80. Group $80_A$ comprises a single cell 50, having its control gate electrode 82 coupled to switching device $66_A$. Group $80_B$ comprises two cells 50, having its interconnected control gate electrode $82_B$ coupled to switching device $66_B$. Group $80_C$ comprises four cells 50, having its interconnected control gate electrode $82_C$ coupled to switching device $66_C$. Group $80_D$ comprises eight cells 50, having its interconnected control gate electrode $82_D$ coupled to switching device $66_D$. All cathode electrodes of all cells 50 of groups $80_A$, $80_B$, $80_C$ and $80_D$ are interconnected as a single cathode 84. The voltage level on cathode 84 is determined by the voltage from adjustable cathode voltage supply 72.

When switching device $66_A$ is energized, as when the signal level at input terminal $70_A$ is enabling to the control input terminal of device $66_A$, the voltage from adjustable gate voltage supply 68 is coupled to control gate electrode $82_A$, comprising the interconnected control gate electrodes of a single cell 50. Similarly, when switching devices $66_B$, $66_C$ and $66_D$ are energized, as when the signal levels at input terminals $70_A$, $70_B$, $70_C$ and $70_D$ are enabling to the respective control input terminals of devices $66_B$, $66_C$ and $66_D$, the voltage from adjustable gate voltage supply 68, is coupled, respectively, to control gate electrodes $82_B$, $82_C$ and $82_D$, which comprise, respectively, the interconnected control gate electrodes of two, four and eight cells 50.

Thus, for a time-varying video input signal, provided at input terminals 70 as digital signals having a binary weighting relationship, a corresponding number of electron emission cells 50 will be energized, thereby providing a beam current from electron emitter 30 which is generally linear with respect to the video input signal. When applied to a CRT of the type shown in FIG. 1, the arrangement of FIG. 4a is capable of sixteen levels of luminance (including black) which are generally linear with respect to the video input signal.

The circuitry illustrated by FIG. 4a provides a dynamic range of fifteen-to-one between maximum and minimum brightness. This may be expanded to 31-to-one or 63-to-one at the cost of doubling or quadrupling the size of the cathode and adding the corresponding number of cells. Contemporary CRT's are often required to have a dynamic range of 400:1 or more if they are used in widely varying ambient light conditions, such as in an air traffic control tower or in an aircraft cockpit. Although sixteen or 32 shades of gray are generally adequate at any one time, some degree of brightness scaling may be needed over a longer time period. This may be achieved by adjusting either the common cathode bias voltage which is derived from supply 72, or by adjusting the magnitude of the upper voltage rail shared by all of the switching devices 66, which is derived from supply 68.

In a preferred configuration, switching devices 66 and other circuits and drivers may be integrated onto the same silicon substrate as the emitter structures 30, thereby increasing the speed of switching devices 66 due to shorter lead lengths and reduced parasitic capacitance. This configuration will allow the CRT to be driven directly from logic levels. Depending on the required clock rate, the input signal may have either a parallel or, with the addition of a shift register (not shown) on the cathode substrate, a serial interface.

Figure 4B:
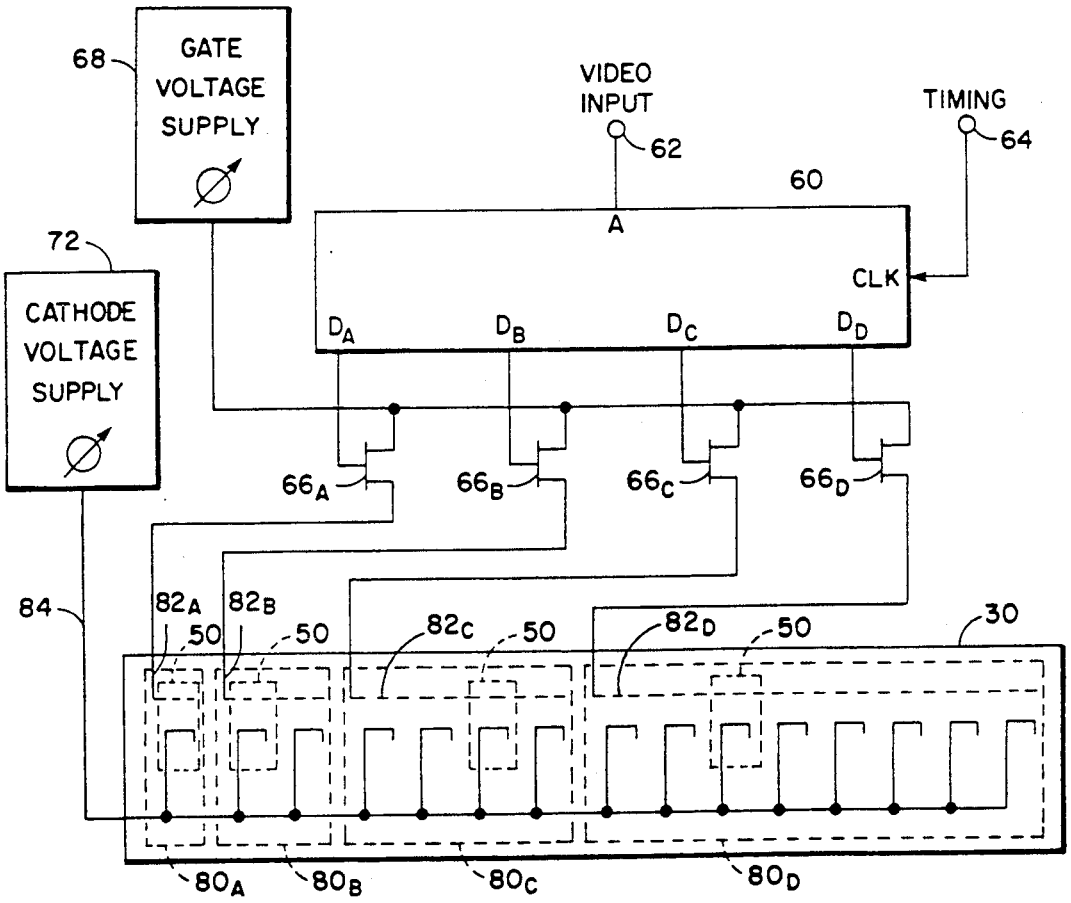
FIG. 4*b* illustrates, in schematic diagram form, a second embodiment of an arrangement for selectively driving groups of electron emitter cells according to the present invention.

Referring to FIG. 4b, there is shown a driver circuit arrangement for groupings of cells of electron emitters according to a second embodiment of the present invention. Included in this arrangement is an analog-to-digital (A/D) converter 60 responsive to an analog video signal applied at terminal 62 and a clocking signal applied at terminal 64 for providing digital signals at the output of converter 60. The output ports of A/D converter 60 are individually coupled to control input terminals of electronic switching devices $66_A$, $66_B$, $66_C$ and $66_D$, which devices are illustratively shown as field-effect transistor (FET) switches.

When switching device $66_A$ is energized, as when A/D converter 60 output terminal $D_A$ provides an enabling voltage level to the control input terminal of device $66_A$, the voltage from adjustable gate voltage supply 68 is coupled to control gate electrode $82_A$, comprising the interconnected control gate electrodes of a single cell 50. Similarly, when switching devices $66_B$, $66_C$ and $66_D$ are energized, as when A/D converter output terminals $D_B$, $D_C$ and $D_D$ provide enabling voltage levels to the respective control input terminals of devices $66_B$, $66_C$ and $66_D$, the voltage from adjustable gate voltage supply 68, is coupled, respectively, to control gate electrodes $82_B$, $82_C$ and $82_D$, which comprise, respectively, the interconnected control gate electrodes of two, four and eight cells 50.

Thus, for a time-varying video input signal applied at input terminal 62 and coupled to the analog input terminal (A) of A/D converter 60, which is strobed by a timing signal applied at input terminal 64 and coupled to the clock input terminal (CLK) of A/D converter 60, a digital representation of that video input signal will be provided at the output terminals $D_A$, $D_B$, $D_C$ and $D_D$ of converter 60. From that digital representation, a corresponding number of electron emission cells 50 will be energized, thereby providing a beam current from electron emitter 30 which is generally linear with respect to the video input signal.

Figure 5:
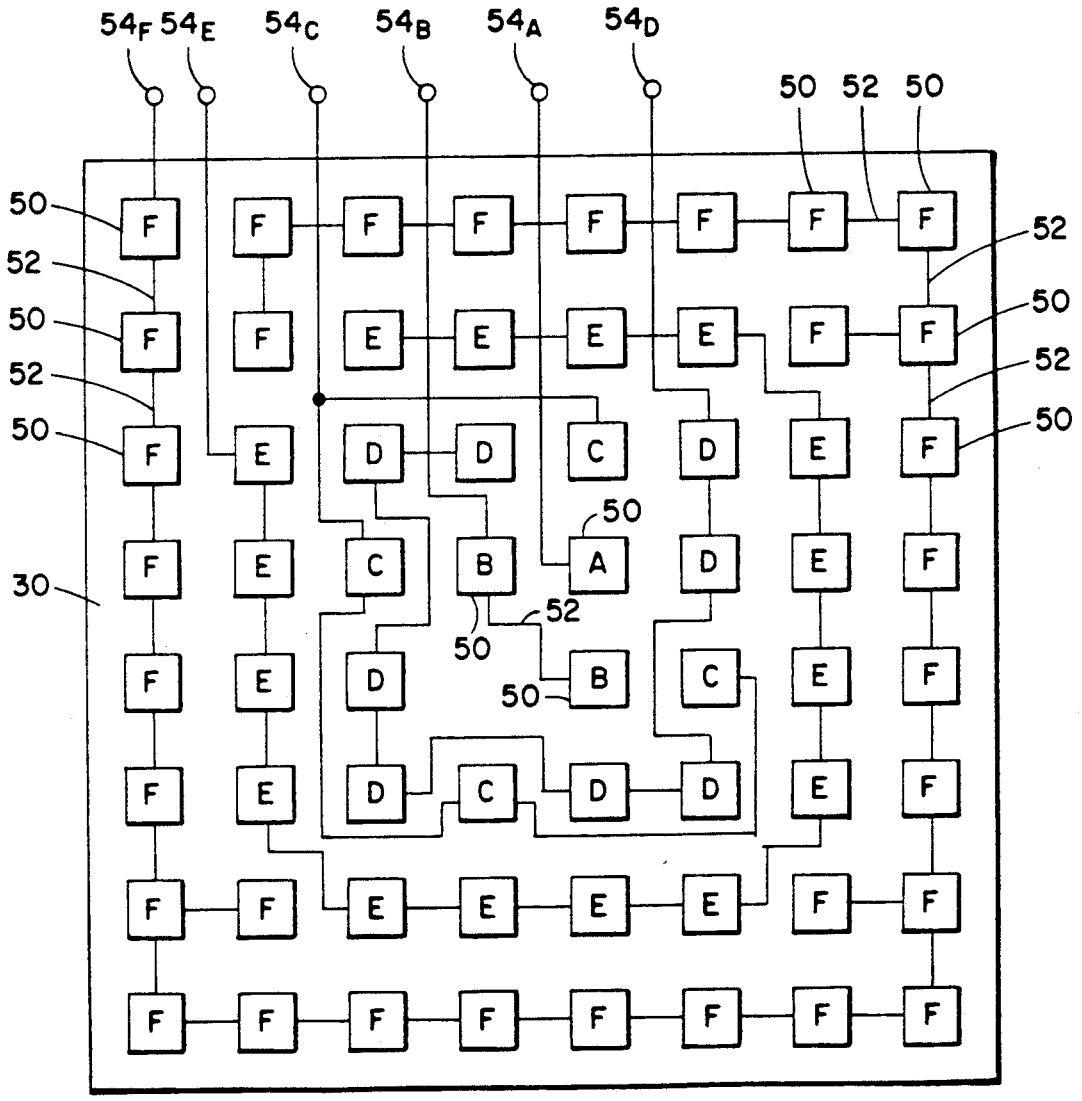
FIG. 5 illustrates a possible positional configuration of cell groups according to the present invention.

Referring to FIG. 5, there is shown a possible positional configuration of cell groups for a CRT electron emission apparatus 30 comprising 63 cells. In particular, FIG. 5 depicts electron emission apparatus 30 including 63 cells 50, groups of which are appropriately electrically coupled via interconnecting leads 52. Signal leads from each of the six groups are brought out to interconnect terminals $54_A$, $54_B$, $54_C$, $54_D$, $54_E$ and $54_F$, referred to collectively as terminals 54. It will be recalled that each cell 50 comprises a plurality of electron emitters having their control gate electrodes connected and their cathode electrodes connected. It will therefore be understood that all cathode electrodes of all of the 63 cells of apparatus 30 are interconnected, and that the interconnecting leads 52 provide selective electrical paths between the interconnected control gate electrodes of cells 50, thereby forming the cell groups.

In the example of FIG. 5, cell group A comprises the single cell 50 labeled "A," cell group B comprises the two cells 50 labeled "B," cell group C comprises the four cells 50 labeled "C," cell group D comprises the eight cells 50 labeled "D," cell group E comprises the sixteen cells 50 labeled "E," and cell group F comprises the 32 cells 50 labeled "F." Thus, by applying a voltage to appropriate ones (or none) of terminals 54, any number of cells, between zero and 63, may be energized.

In order to distribute the current loading as uniformly as possible, the cells 50 of each of the six groups in the FIG. 5 embodiment are generally symmetrically positioned around electron emission apparatus 30. Thus, it is easily seen that energizing any number of groups will provide a generally uniform distribution of emitted electrons.

The generally square arrangement of cells 50 on the surface of apparatus 30 should not be seen as a limiting configuration. The orientation may be square, as shown, or it may be circular or even an irregular pattern. The optimal design must take into account power distribution and the equalization and minimization of lead lengths.

While the principles of the present invention have been demonstrated with particular regard to the illustrated structure of the figures, it will be recognized that various departures may be undertaken in the practice of the invention. The scope of this invention is not intended to be limited to the particular structure disclosed herein, but instead be gauged by the breadth of the claims which follow.

What is claimed is:

1. Electron emission apparatus comprising:

a multiplicity of field emission electron emitters, each of said emitters comprising a cathode electrode and a gate electrode and responsive to a predetermined potential therebetween for emitting electrons from said cathode, wherein all of said cathode electrodes are electrically interconnected, said gate electrodes being interconnected to form a first plurality of cells, each of said cells comprising an equal number of electron emitters, said cells being interconnected to form a second plurality of groups, said groups comprising different numbers of cells; and means for selectively applying said predetermined potential between said cathodes and said interconnected gate electrodes of said interconnected cells of said groups.

2. The apparatus according to claim 1 wherein said multiplicity of field emission electron emitters are fabricated on an electrically-conductive planar surface using thin-film devices.

3. The apparatus according to claim 2 wherein said cathode electrodes of said multiplicity of field emission electron emitters are electrically coupled to said conductive planar surface.

4. The apparatus according to claim 2 wherein said gate electrodes of said multiplicity of field emission electron emitters comprise a metalized layer spaced from said conductive planar surface by an insulating layer.

5. The apparatus according to claim 4 wherein said metalized layer comprises a plurality of electrically-isolated sections, wherein each of said sections comprises the interconnected gate electrodes of one of said cells.

6. The apparatus according to claim 5 wherein said sections of said metalized layer include coupling means for interconnecting said cells into said groups of cells.

7. The apparatus according to claim 1 wherein the numbers of interconnected cells forming said second plurality of groups are related according to a binary progression.

8. An apparatus responsive to an input signal for providing an electron beam current in a cathode-ray tube, said apparatus comprising:

a multiplicity of field emission electron emitters, each of said emitters comprising a cathode electrode and a gate electrode and responsive to a predetermined potential therebetween for emitting electrons from said cathode, wherein all of said cathode electrodes are electrically interconnected, said gate electrodes being interconnected to form a first plurality of cells, each of said cells comprising an equal number of electron emitters, said cells being interconnected to form a second plurality of groups, said groups comprising different numbers of cells; and means responsive to said input signal for selectively applying said predetermined potential between said cathodes and said interconnected gate electrodes of said interconnected cells of said groups, wherein the emission of electrons from said cathodes is related to the amplitude of said input signal.

9. The apparatus according to claim 8 wherein said multiplicity of field emission electron emitters are fabricated on an electrically-conductive planar surface using thin-film devices.

10. The apparatus according to claim 9 wherein said cathode electrodes of said multiplicity of field emission electron emitters are electrically coupled to said conductive planar surface.

11. The apparatus according to claim 9 wherein said gate electrodes of said multiplicity of field emission electron emitters comprise a metalized layer spaced from said conductive planar surface by an insulating layer.

12. The apparatus according to claim 11 wherein said metalized layer comprises a plurality of electrically-isolated sections, wherein each of said sections comprises the interconnected gate electrodes of one of said cells.

13. The apparatus according to claim 12 wherein said sections of said metalized layer include coupling means for interconnecting said cells into said groups of cells.

14. The apparatus according to claim 8 wherein the numbers of interconnected cells forming said second plurality of groups are related according to a binary progression.

15. A cathode-ray tube comprising:

a sealed envelope having a surface therein responsive to electron beam current for providing light energy;

electron emission means within said envelope responsive to an input signal for providing an electron beam current including: a multiplicity of field emission electron emitters, each of said emitters comprising a cathode electrode and a gate electrode and responsive to a predetermined potential therebetween for emitting electrons from said cathode, wherein all of said cathode electrodes are electrically interconnected, said gate electrodes being interconnected to form a first plurality of cells, each of said cells comprising an equal number of electron emitters, said cells being interconnected to form a second plurality of groups, said groups comprising different numbers of cells; and means responsive to said input signal for selectively applying said predetermined potential between said cathodes and said interconnected gate electrodes of said interconnected cells of said groups, wherein the emission of electrons from said cathodes is related to the amplitude of said input signal;

means within said envelope for accelerating said electron beam current from said electron emission means toward said surface; and means for selectively deflecting said electron beam current to positions on said surface.

16. The cathode-ray tube according to claim 15 wherein said multiplicity of field emission electron emitters are fabricated on an electrically-conductive planar surface using thin-film devices.

17. The cathode-ray tube according to claim 16 wherein said cathode electrodes of said multiplicity of field emission electron emitters are electrically coupled to said conductive planar surface.

18. The cathode-ray tube according to claim 16 wherein said gate electrodes of said multiplicity of field emission electron emitters comprise a metalized layer spaced from said conductive planar surface by an insulating layer.

19. The cathode-ray tube according to claim 18 wherein said metalized layer comprises a plurality of electrically-isolated sections, wherein each of said sections comprises the interconnected gate electrodes of one of said cells.

20. The cathode-ray tube according to claim 19 wherein said sections of said metalized layer include coupling means for interconnecting said cells into said groups of cells.

21. The cathode-ray tube according to claim 15 wherein the numbers of interconnected cells forming said second plurality of groups are related according to a binary progression.

* * * * *